United States Patent [19]

McGovern et al.

[11] Patent Number: 4,729,903

[45] Date of Patent: Mar. 8, 1988

[54] PROCESS FOR DEPOSITING I-125 ONTO A SUBSTRATE USED TO MANUFACTURE I-125 SOURCES

[75] Inventors: James J. McGovern, Monroe; Joseph M. Olynyk, Warwick, both of N.Y.

[73] Assignee: Midi-Physics, Inc., Emeryville, Calif.

[21] Appl. No.: 872,721

[22] Filed: Jun. 10, 1986

[51] Int. Cl.[4] ..... B05D 5/00

[52] U.S. Cl. ..... 427/5; 427/248.1; 250/493.1

[58] Field of Search ..... 250/493.1; 427/5, 248.1

[56] References Cited

U.S. PATENT DOCUMENTS

| | | | |
|---|---|---|---|
| 3,326,178 | 6/1967 | DeAngelis | 427/5 X |
| 3,711,326 | 1/1973 | Parry et al. | 427/5 |
| 3,745,067 | 7/1973 | Arino et al. | 176/16 |
| 3,832,222 | 8/1974 | Crisler et al. | 427/5 |
| 4,382,974 | 5/1983 | Yannopoulos | 427/5 |

OTHER PUBLICATIONS

Large Scale Preparation of High Purity $^{131}I$ and $^{133}Xe$ by Sorption Techniques, Case & Acree, Jan. 1966, Oakridge National Laboratory.

Iwamoto et al., Journal of Nuclear Science and Technology, 5, [9], pp. 437–446 (1968).

Richard et al., Journal of Radioanalytical and Nuclear Chemistry, Articles 82/1 (1984), pp. 81–91.

Lin et al., J. Atomic Energy Soc., (Japan), S-182 (1963).

M. L. Good, "The Anion Exchange Separation of Iodine Anions", J. Inorg. Chem., 6, 73 (1958).

Acta. Radiologica, vol. 3, Fasc. 2 (Apr. 1965), pp. 152–160, Beronius et al.

*Primary Examiner*—Shrive P. Beck

*Attorney, Agent, or Firm*—Jon S. Saxe; Bernard S. Leon; Matthew Boxer

[57] ABSTRACT

The invention relates to a process for depositing I-125 on a substrate which comprises contacting a predetermined surface area of substrate with Xe-125 gas, whereby the Xe-125 decays to I-125 and the I-125 in turn deposits as a solid on the surface of the substrate, the contact being for a time sufficient to deposit at least about 1 microcurie of I-125. I-125 is thereby deposited in a relatively uniform amount over the surface area of the substrate. The substrate is then assayed to determine how much I-125 has been deposited. The substrate is then divided into pieces of measured surface area, each piece therefore containing a measured amount of deposited I-125, and each piece can then be used in the manufacture of an I-125 source.

11 Claims, No Drawings

PROCESS FOR DEPOSITING I-125 ONTO A SUBSTRATE USED TO MANUFACTURE I-125 SOURCES

BACKGROUND OF THE INVENTION

1. Field of the Invention

The invention relates to a process for preparing a substrate containing I-125 used to manufacture radioactive I-125 sources. Such radioactive sources are used in devices for measuring bone density in the body, that is, in bone densitometers. Such sources are also used in diagnostic devices such as portable devices for taking X-rays. Furthermore, such sources are used in radiation therapy, as in treating tumors. In radiation therapy, I-125 sources are typically called "seeds." It is important that such I-125 sources contain measured amounts of I-125.

2. Description of the Prior Art

Various ways to deposit I-125 on a substrate are known such as treating very small resin beads, typically 1 to 2 millimeter spheres, or small pieces of wire, typically 1 to 2 millimeters in length with a liquid phase which contains I-125, for example, in the form of a salt. I-125 is thus caused to be deposited from the liquid phase onto the beads or wire which serve as the substrate.

I-125 has also been deposited from a basic liquid solution onto a nylon filament. This procedure is described in more detail in U.S. Pat. No. 3,351,049.

I-125 has also been deposited on a substrate as follows: a silver substrate is chlorided by an electrochemical process, followed by treatment of the chlorided substrate with a basic sodium iodide solution. This process is more fully described in U.S. Pat. No. 4,323,055.

Disadvantages of the above processes for depositing I-125 on substrates include the fact that it is hard to control the amount of I-125 deposited upon a substrate by these above processes, and furthermore, by these above processes, uniform deposition of I-125 over the substrate is not obtainable.

An additional disadvantage of these prior art processes is that it is difficult to handle the substrates, such as the resin beads or pieces of wire or nylon, that are prepared. Because of this difficulty in handling, there exists the potential danger of irradiation to the operator and the further problem of contamination of the I-125 source prepared.

BRIEF SUMMARY OF THE INVENTION

The invention relates to a process for depositing I-125, on a substrate, which comprises (a) suspending a substrate of predetermined surface area in a pressure vessel, (b) contacting the substrate with Xe-125 gas, whereby Xe-125 gas decays to I-125 gas, and (c) depositing at least about 1 microcurie of I-125 gas as a solid on the surface of the substrate.

The resulting substrate, upon which I-125 is deposited, is easily handled and thus avoids the potential danger of irradiation of the operator and avoids the further problem of contamination of the source.

The process of the invention allows for relatively uniform deposition of I-125 over the surface area of the substrate. Accordingly, after deposition upon a substrate has been completed, the substrate can be assayed by conventional means such as, for example, by a gamma ionization chamber to determine the total amount of I-125 which has been deposited on the substrate. The substrate can then be subdivided into pieces of preselected surface area, each having a measured amount of I-125. Each piece of substrate can then be used in manufacturing an I-125 source, having a measured amount of I-125.

DETAILED DESCRIPTION OF THE INVENTION

As used herein, the term "I-125" denotes radioactive iodine-125, and the term "Xe-125" denotes radioactive xenon-125.

The invention relates to a process for depositing I-125 on a substrate which comprises (a) suspending a substrate of predetermined surface area in a pressure vessel, (b) contacting the substrate with Xe-125 gas, whereby the Xe-125 gas decays to I-125 gas and (c) depositing at least about 1 microcurie of I-125 gas as a solid on the surface of the substrate.

The substrate employed may be any iodine-absorbent material that is any material upon which gaseous iodine will deposit. As defined herein any substrate that allows physisorption and/or chemisorption of iodine through inherent or enhanced characteristics as by activation or impregnation is iodine-absorbent and therefore is suitable. Examples of materials which can be used as substrates include graphite, silver, copper, platinum, platinum impregnated charcoal, and most preferred is silver impregnated graphite for use in a bone densitometer.

Examples of substrates include graphite ribbon, graphite ribbon impregnated with silver, silver wire, silver foil ribbon, silver mirror, platinum wire, charcoal impregnated with platinum, graphite impregnated with potassium iodide, aluminum oxide impregnated with silver, activated charcoal, copper wire, copper foil, copper beads and anion exchange resin.

A silver impregnated graphite substrate can be prepared as follows. A piece of pure graphite ribbon is placed in a shallow tray of an inert material such as teflon, ceramic, or more preferably glass. The graphite is covered with a 1:1 by volume mixture of nitric and sulfuric acids.

The graphite is then rinsed with deionized water and treated with a solution of silver nitrate in nitric acid. A solution of sodium sulfite is added. The solution is then made basic, heated and allowed to stand. The treated graphite is removed from the reaction mixture, rinsed with deionized water, and dried.

Additional substrates include an organic resin for iodine such as a strongly or weakly basic anion exchange resin like AG3-X4A which is weakly basic, as well as silver impregnated resins. It will be understood that higher atomic numbered elements block radiation and therefore lower the usable radioactivity of the eventual I-125 source produced. It is also noted, that in some applications, a substrate of high atomic number is desirable. For instance, in those cases where the I-125 source is to be used as a seed in radiation therapy, a substrate of an element of higher atomic number allows for location of the I-125 source within the body by X-rays. Thus, a silver wire is a preferred implant source for radiation therapy.

The shape of the substrate is not critical, however, the substrate should be of such a shape as to allow for the premeasurement of the surface area of the substrate. Additionally, the shape of the substrate can preferably be such that it may be easily divided into pieces of smaller measurable surface area. Accordingly, the examples of shapes for the substrate include a hollow cylinder with the ends cut off, a filament or thread, in the case of silver, silver mirrors that have been formed upon the ends of glass rods or any suitable support all of the same cross-sectional area, and, most preferably a ribbon.

Preferred among substrates are graphite ribbons and most preferably graphite ribbons impregnated with silver. A substrate of predetermined surface area is disposed, located or suspended in a pressure vessel and is contacted with a gaseous mixture containing Xe-125 gas (Xe-125 as used herein also refers to Xe-125 in the solid, liquid or gaseous phases). Typically, the gaseous mixture containing Xe-125 is prepared by exposing a Xe-124 enriched xenon gaseous mixture to a neutron flux, as from a conventional nuclear reactor like a thermal nuclear research reactor or any other thermal nuclear reactor. The substrate may be disposed, located or suspended in any conventional manner, as by hanging or by placing the substrate on the floor of the pressure vessel.

The resulting gaseous mixture containing Xe-125 is then pumped or otherwise placed into a pressure vessel containing the substrate, thereby containing the substrate. The walls of the pressure vessel are of stainless steel or other material upon which I-125 is not easily deposited. It is desirable to select the pressure vessel, such that I-125 is not easily deposited on the walls thereof, while in comparison, I-125 is easily deposited on the surfaces of the substrate. The vessel should be of such construction as to withstand from about 1 to about 200 atmospheres of pressure. The walls of the pressure vessel must be impermeable to xenon and like gases. The pressure vessel may be further enclosed in a radioactive shield material that is a material which blocks radiation. Lead or uranium are such shield materials.

Xe-125 spontaneously decays to I-125 which preferentially deposits on the surface of the substrate as opposed to the walls of the container. The surface area of the substrate, the material of the substrate, the concentration of the Xe-125 used, and the duration of contact with Xe-125, all determine the Curies of I-125 that are deposited.

The length of time of contact can range from about a second to several days. More specifically, the length of time of contact can be as short as the mechanical steps of contacting the substrate with Xe-125 and removing the Xe-125 will allow. The upper limit to the length of time of contact is determined by decay of Xe-125. Typically, the upper limit to the length of time of contact is 5 days. The length of time of contact is, for example, about one to 5 days, preferably about two (2) days. However, when it is desired to deposit only a small amount of I-125 on the substrate, the length of time of contact can be as little as about 1 second.

In preparing the source of this invention, the amount of I-125 deposited on the substrate is at least about 1 microcurie. Generally, the amount of I-125 deposited is at least about 5 millicuries to about 20.0 curies or about 100 millicuries to about 20.0 curies being preferred.

The amount of I-125 specifically loaded, wherein the substrate is silver impregnated graphite can range from about 10–1500 Curies/gram.

The concentration of Xe-125 gas employed may be such that about 10–5000 Curies, or more preferably about 100–500 Curies of Xe-125 are in contact with the substrate.

In an alternative embodiment of the invention, the substrate can be contacted with newly prepared Xe-125 two or more times. Each additional contact of the substrate by Xe-125 deposits additional I-125 on the substrate.

The I-125 is deposited rather unformly over the surface area of the substrate. The entire substrate is assayed by conventional means such as a gamma ionization chamber. Because I-125 is deposited rather uniformly over the surface area of the substrate, the substrate is subdivided into pieces of measured surface area each of which then possesses a measured portion of the I-125 deposited. Each piece of substrate can then be used in manufacturing an I-125 source. Each I-125 source so manufactured contains a measured amount of I-125. Generally, in all applications such as X-ray machines and bone densitometers, it is critical that an I-125 source contain a measured amount of I-125.

Typically, in the manufacture of an I-125 source, the substrate is placed in a primary, cylindrical capsule of, for example, stainless steel which can, for example, be about 0.05–5 mm diameter and about 1–20 mm length. Additional filler such as glass, aluminum, or stainless steel, may be added to the primary capsule if necessary. Said capsule typically has one end, for example, of aluminum, through which radiation passes. The other end is then sealed with steel-filled epoxy, for example. The primary capsule is then placed into a larger, secondary capsule, and sealed within, to complete the manufacture of the I-125 source.

Other methods of manufacturing I-125 sources are known. U.S. Pat. Nos. 3,351,409 and 4,323,055 disclose methods for manufacturing I-125 sources, and the contents of these two U.S. patents are incorporated by reference.

In one embodiment of the invention, a stainless steel pressure vessel in which is suspended a graphite ribbon is connected via a tube to a container of xenon gas of which 40% is the isotope Xe-124. The xenon gas is irradiated with a neutron flux from any conventional source, such as an appropriate nuclear reactor to form a gaseous mixture of products including Xe-125 gas. The mixture including Xe-125 gas is cryogenically pumped into the stainless steel pressure vessel containing the graphite ribbon. A sufficient amount of the mixture including Xe-125 gas is introduced so that about 10–5000 Ci of Xe-125 is transferred into the stainless steel pressure vessel in this manner. For example, about one and a half liters of xenon gas mixture at standard temperature and pressure conditions is introduced into the stainless steel pressure vessel at 10 atmospheres of pressure. The Xe-125 remains in contact with the graphite ribbon for a period of about 1 second up to several days. During this time, Xe-125 gas spontaneously decays to I-125 gas which deposits as a solid on the surface of the substrate. Then the Xe-125 and the remainder of the gaseous mixture is removed from the substrate, for example by pumping.

If additional I-125 is desired to be deposited upon the substrate, the above steps are repeated. That is, Xe gas enriched with 40% Xe-124 gas is irradiated with a neutron flux for about 1 day in order to obtain from 10 to about 5000 Ci of Xe-125 in the Xe-124 target gas. A newly irradiated sample is contacted with the already treated substrate a second time. Of course, further deposition of I-125 on the substrate can be achieved by further repetitions of these steps. Up to 1500 Ci/gm of I-125 can generally be deposited on a substrate of silver impregnated graphite, however, more can be deposited as described above if necessary.

By this process I-125 is rather uniformly deposited upon the substrate.

In an alternative embodiment of the invention, the walls of the stainless steel pressure vessel may be heated to from about 80° to about 100° C. during deposition of I-125 upon the substrate. This causes I-125 which has deposited as a solid on the walls of the pressure vessel to sublime from the walls of the pressure vessel and redeposit on the surface of the substrate.

The substrate is then assayed by conventional means such as by a gamma ionization chamber to determine the total amount of I-125 that has been deposited.

The substrate upon which has been deposited I-125 may then be divided into pieces of smaller and predetermined surface area in order to obtain pieces of substrate, each bearing a measured amount of I-125. For example, if the substrate is a graphite ribbon, the graphite ribbon may be cut up into portions of equal length, each portion of which will contain relatively the same amount of I-125 as the other pieces. The measured pieces of I-125 substrate are then fabricated into various I-125 sources as described above.

The following examples further illustrate the invention but in no way limit the scope of the invention.

EXAMPLE 1

A 0.125 millimeter thick, 1 millimeter wide and 14 centimeter long graphite, silver impregnated ribbon was suspended via a helical steel spring in a 304 stainless steel pressure vessel of 75 milliliter capacity. The pressure vessel was further enclosed in a radioactive shield material, lead. The silver impregnated graphite ribbon was contacted for about 1 day with approximately 800 Ci of Xe-125 that was induced in a target consisting of pure xenon gas which was enriched to about 40% in the Xe-124 isotope by irradiation with thermal neutrons in a thermal nuclear reactor for 24 hours and then moved into the stainless steel pressure vessel containing the silver impregnated graphite ribbon and allowed to contact said ribbon for a period of 2 days.

The xenon gas mixture was removed and the cycle was repeated a second time. Approximately 5.6 Ci of I-125 was deposited on the silver impregnated graphite ribbon with a distribution as shown below:

TABLE

| Segment of silver impregnated graphite ribbon | Length (Cm) | % Loaded |
|---|---|---|
| 1 | 2.0 | 15.0 |
| 2 | 2.0 | 12.5 |
| 3 | 2.0 | 10.5 |
| 4 | 2.0 | 17.0 |
| 5 | 2.0 | 12.6 |
| 6 | 2.0 | 19.0 |
| 7 | 1.5 | 13.4 |

As can be seen, 0.5 centimeters of the ribbon are not shown in the table above. The missing 0.5 cm was distributed among segments 1 through 6 inclusive.

In the table above, % loaded means percentage of the total 5.6 Ci of I-125 which was deposited in the segment indicated.

The silver-impregnated graphite ribbon used in the above example, was prepared as follows.

Thin sheets of pure graphite, about 0.005 inches thick, were cut into pieces of about 10 inches by ½ inch, and placed in a shallow glass tray. The graphite was covered about ¼ inch deep with a 1:1 by volume mixture of concentrated nitric and sulfuric acids. The graphite was allowed to stand, for 20 minutes, covered with the acid mixture.

The acid mixture was rinsed off with a continuous flow of deionized water. Rinsing with deionized water was continued until the pH of the rinse water was greater than 2.0.

The graphite was then supported on a hollow glass cylinder open at both ends by taping it at both the top and the bottom using teflon tape. The size and shape of the hollow glass cylinder was such that it could be suspended in the reaction flask and permit the graphite to be exposed to the stirred and heated reaction mixture.

The support and graphite were suspended near the center of a cylindrical reaction flask which was heated and contained a teflon coated magnetic stirring bar. The reaction flask was placed on a stirring plate.

213 ml of deionized water and 73 ml of 10% silver nitrate in 0.1N nitric acid were added so as to cover the graphite. The mixture was stirred for 5 minutes.

While stirring was continued, 32 ml of freshly prepared 5% sodium sulfite were added. Stirring was continued for 5 minutes.

While stirring was continued, 320 ml of 0.1N sodium hydroxide was added so that the pH of the solution was at least 13 after addition of the sodium hydroxide. Additional 0.1N sodium hydroxide was added so as to keep the pH of the solution at least 13. The mixture was heated to a temperature between about 80° C. and 95° C., and then heating was stopped. The mixture was stirred for an additional 30 minutes.

The supported graphite was removed from the reaction mixture and rinsed with deionized water until the pH of the rinse water was about the same as the pH of deionized water before rinsing. The graphite was dried on a glass plate in a vacuum oven at 80°–90° C. for about 8 hours and stored in a vacuum dessicator.

What is claimed is:

1. A process for depositing I-125 on a substrate, which comprises (a) suspending a substrate of predetermined surface area in a pressure vessel, (b) contacting the substrate with Xe-125 gas, whereby Xe-125 decays to I-125 gas, and (c) depositing at least about 1 microcurie of I-125 gas as a solid on the surface of the substrate.

2. A process in accordance with claim 1, which comprises depositing at least about 5 millicuries of I-125.

3. A process in accordance with claim 2, which comprises depositing at least about 100 millicuries of I-125.

4. A process in accordance with claim 3, which comprises depositing at least about 10.0 Curies of I-125.

5. A process in accordance with claim 1, wherein the substrate of predetermined surface area is contacted with Xe-125 gas two or more times.

6. A process in accordance with claim 1, which further comprises assaying the contacted substrate to determine the amount of I-125 deposited, and subdividing the substrate into portions of predetermined surface area.

7. A process in accordance with claim 1, wherein the substrate is iodine absorbent.

8. A process in accordance with claim 7, wherein the substrate is selected from the group consisting of graphite ribbon, graphite ribbon impregnated with silver, silver wire, silver foil ribbon, silver mirror, platinum wire, charcoal impregnated with platinum, graphite impregnated with potassium iodide, aluminum oxide impregnated with silver, activated charcoal, copper wire, copper foil, copper beads and anion exchange resin.

9. A process in accordance with claim 8, wherein the substrate is graphite ribbon.

10. A process in accordance with claim 8, wherein the substrate is graphite ribbon impregnated with silver.

11. A process in accordance with claim 8, wherein the substrate is silver wire.

* * * * *